United States Patent [19]

Bickes, Jr. et al.

[11] Patent Number: 4,843,964

[45] Date of Patent: Jul. 4, 1989

[54] SMART EXPLOSIVE IGNITER

[75] Inventors: Robert W. Bickes, Jr.; Kevin D. Marbach; Paul D. Wilcox, all of Albuquerque, N. Mex.

[73] Assignee: The United States of America as represented by the United States Department of Energy, Washington, D.C.

[21] Appl. No.: 150,805

[22] Filed: Feb. 1, 1988

[51] Int. Cl.[4] ..... F42C 19/12

[52] U.S. Cl. ..... 102/202.5; 102/220

[58] Field of Search ..... 102/202.5, 215, 218, 102/220

[56] References Cited

U.S. PATENT DOCUMENTS

| | | | |
|---|---|---|---|
| 2,996,991 | 8/1961 | Menzel | 102/70.2 |
| 3,329,092 | 7/1967 | Bassie | 102/70.2 |
| 3,882,323 | 5/1975 | Smolker | 102/215 |
| 3,882,324 | 5/1975 | Smolker et al. | 102/215 |
| 3,979,580 | 9/1976 | Crilly et al. | 235/150.53 |
| 4,145,970 | 3/1979 | Hedberg et al. | 102/218 |
| 4,254,475 | 3/1981 | Cooney et al. | 364/900 |
| 4,374,492 | 2/1983 | Goldberg et al. | 102/220 |
| 4,434,717 | 3/1984 | Erickson | 102/220 |
| 4,559,875 | 12/1985 | Marshall | 102/218 |
| 4,651,646 | 3/1987 | Foresman et al. | 102/208 |
| 4,708,060 | 11/1987 | Bickes, Jr. et al. | 102/202.7 |
| 4,712,477 | 12/1987 | Aikou et al. | 102/202.5 |
| 4,730,558 | 3/1988 | Florin et al. | 102/218 |

*Primary Examiner*—Charles T. Jordan

*Attorney, Agent, or Firm*—George H. Libman; James H. Chafin; William R. Moser

[57] ABSTRACT

A non electrically conductive substrate includes both an SCB and a semiconductor switch, the switch being electrically connected to cause the SCB to fire when the switch is triggered.

8 Claims, 4 Drawing Sheets

SMART EXPLOSIVE IGNITER

The United States Government has rights in this invention pursuant to Contract No. DE-AC04-76DP00789 between the Department of Energy and AT&T Technologies, Inc.

BACKGROUND OF THE INVENTION

This invention relates generally to a logic-controlled explosive igniter, and more particularly to a semiconductor bridge igniter mounted on the same semiconductor die as its triggering switch.

A new igniter of a semiconductor nature which is especially useful in conjunction with insensitive high explosives and pyrotechnics is the semiconductor bridge ignitor (SCB) disclosed in U.S. Patent No. 4,708,060 of Robert Bickes, et al. As disclosed therein, an SCB is an electrical material (typically, a highly doped semiconductor) formed as a bridge of small size (e.g. 100 um long x 400 um wide), having a resistance on the order of one ohm, extending between two spaced conductive pads. Application of a relatively low power pulse (e.g. 15 us, 25 A, 3 mJ) across the bridge causes the bridge to burst, igniting an explosive charge placed against the bridge. The device may typically be packaged in a small container with the electrical leads at one end and the explosive at the other end. The particular advantages of the SCB include ease of manufacture, repeatability of fire characteristics, and safety. Further details may be found in the aforementioned patent, the disclosure of which patent is incorporated herein by reference.

A prior art detonator cap is shown in U.S. Pat. No. 4,145,970 of J. Hedberg et al., Mar. 27, 1979. This patent discloses a cylindrical case having an explosive charge at one end thereof, an electrically initiated device adjacent the explosive charge, and a control circuit comprising a capacitor that is charged through a first relay upon receipt of a first signal, and a delay circuit that closes a second relay to discharge the capacitor to fire the device after a predetermined delay. An isolating transformed is used for frequency tuning and isolating the applied voltage.

By nature, a detonating device is only used once. Accordingly, it is highly desirable to minimize the cost of each detonator. The device of Hedberg requires a plurality of electrical connections between discrete electronic components, a labor-intensive construction.

SUMMARY OF THE INVENTION

It is an object of this invention to provide an inexpensive explosive igniter.

It is another object of this invention to provide an explosive igniter in a small package.

It is still another object of this invention to provide an explosive igniter and a firing switch on the same substrate.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the present invention may comprise a non electrically conductive substrate containing both an SCB and a semiconductor switch, the switch being electrically connected to cause the SCB to fire when the switch is triggered.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION

The smart explosive igniter of this invention is a very compact device containing an explosive charge that is safely ignited only upon the charging of a firing capacitor and the discharge of this capacitor through a SCB upon the triggering of logic-controlled electronic switch.

Figure 1:
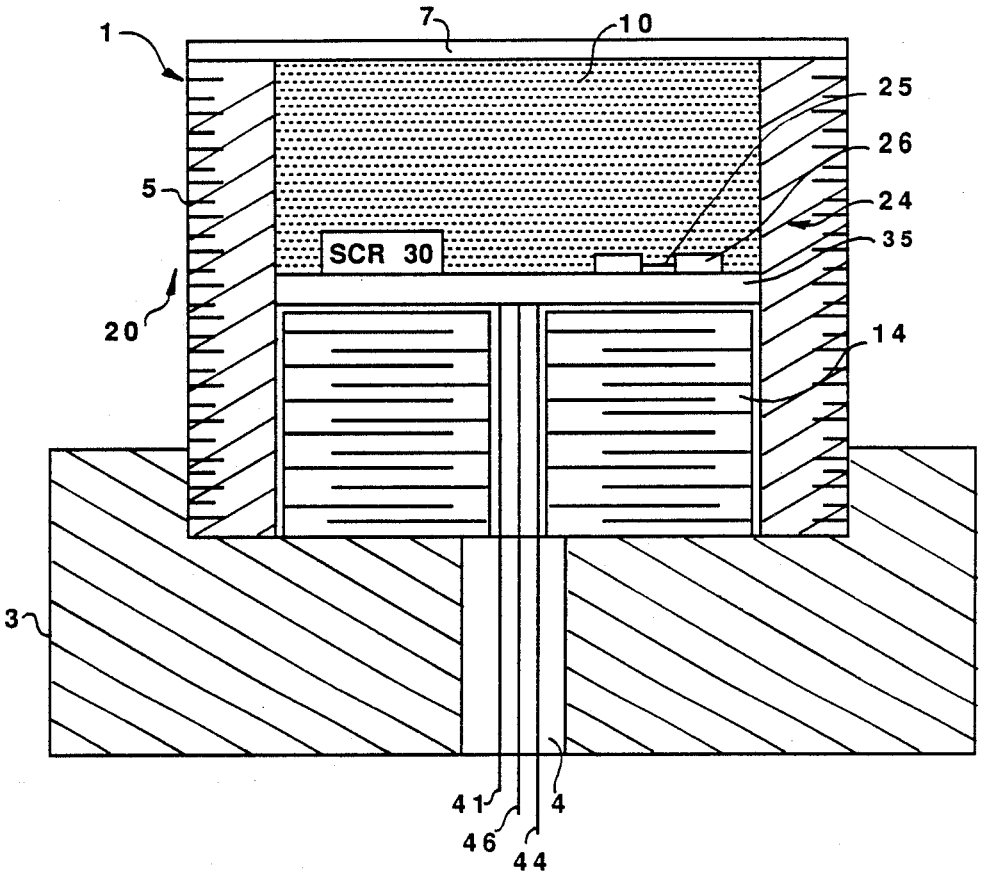
FIG. 1 shows a cutaway view of one embodiment of the invention.

The construction of a smart explosive igniter 1 in accordance with one embodiment of this invention is shown in FIG. 1 to include a metal cap 3 screwed onto one end of a hollow metal cylindrical housing 5. The opposite end of housing 5 is sealed with a hermetic closure disk 7 made of of plastic, metal, or similar material. Housing 5 contains an explosive 10, a circuit 20 on one or more substrates 35, as discussed in greater detail below, and a firing capacitor 14. Circuit 20 includes a SCB 24 for igniting explosive 10 as taught by the aforementioned U.S. Pat. No. 4,708,060. Electrical or optical leads are connected to circuit 20 through an opening 4 in base 3 and capacitor 14.

Figure 2:
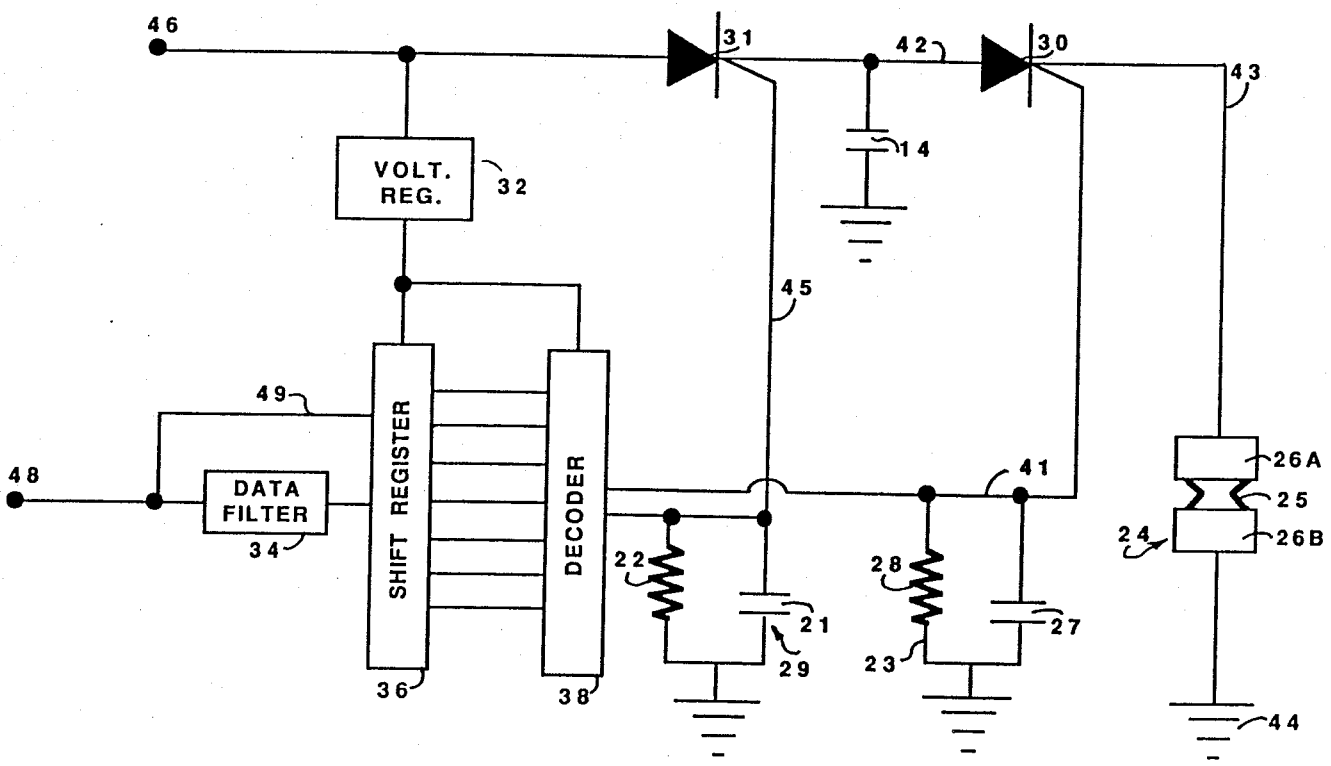
FIG. 2 shows a circuit diagram in accordance with one embodiment of the invention.
Figure 4A:
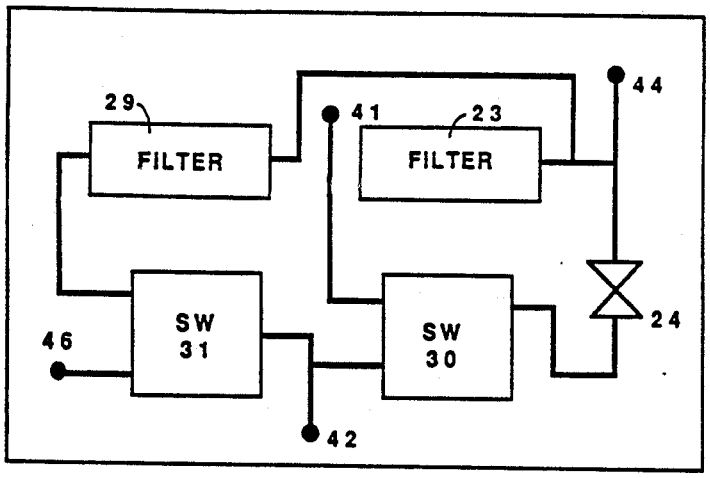
FIGS. 4A and 4B show, respectively, each side of a substrate in accordance with the embodiment of FIG. 2.
Figure 5:
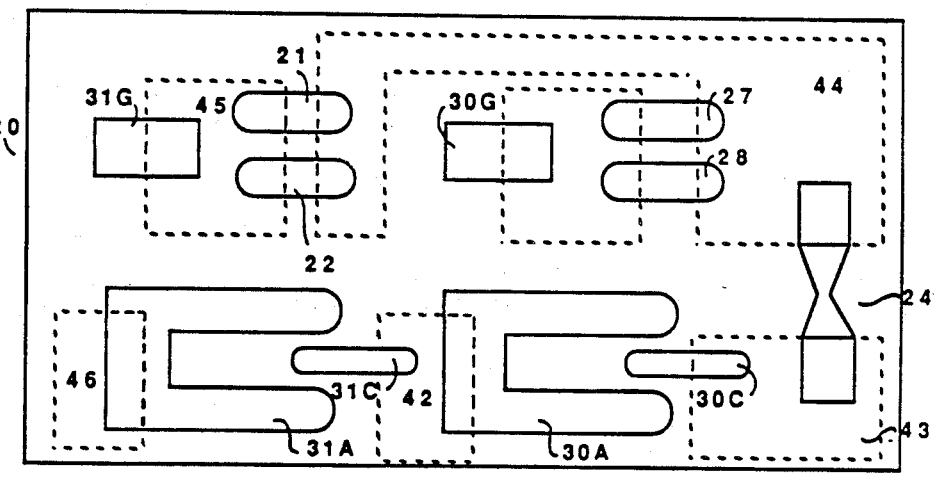
FIG. 5 shows layout for the components of FIG. 4A.

The circuitry of circuit 20 is shown in FIGS. 2, 4A, and 5 to include an electronic switch such as SCR 31 for connecting the power applied at terminal 46 to capacitor 14, and a second switch such as SCR 30 for discharging capacitor 14 through SCB 24 to ground 44. Control of the SCRs may be provided by serial pulse train applied at terminal 48. As is well known to those familiar with digital signaling, this signal is fed through line 49 to provide a clocking input to shift register 36, and through data filter 34 to provide the data to shift register 36. Data filter 34 may be a conventional diode-resistor network. Shift register 36 converts the serial data pulses into a parallel output that is read by decoder 38, which decoder may be a logic circuit comprised of conventional gates arranged to provide first and second outputs upon the input of predetermined first and second words. Typical five volt power for each of shift register 36 and decoder 38 is taken from terminal 46 through a voltage regulator 32 of conventional design.

When the first predetermined word is decoded by decoder 38, the output at line 45 triggers SCR 31 to a conduction state, permitting the voltage at terminal 46 to change capacitor 14. Filter 29, consisting of parallel capacitor 21 and resistor 22, protects SCR 31 from accidentally triggering due to spurious signals on line 45.

If the second predetermined code word is decoded, the output of decoder 38 on line 41 triggers SCR 30 to a conducting state, causing capacitor 14 to discharge through, and thereby ignite, SCB 24. Filter 23, consisting of parallel capacitor 27 and resistor 28, protects SCR 30 from accidental triggering.

SCB 24 is seen to consist of a layer of highly doped semiconductor forming bridge 25. The ends of bridge 25 are defined by spaced metal pads 26A, 26B, which pads provide a means for making electrical connections to the bridge. A particular advantages of the SCB in this invention include its lack of jitter; i.e., it predictably ignites 50 us after the pulse is applied, permitting the use of accurate digital time delay circuitry as taught by this invention. Ordinary hot wire igniters have a millisecond response time to the firing pulse.

It should be understood that transistors or other known electronic switches may be used in place of SCRs 30 and 31. Furthermore, capacitor 14, and its attendant SCR 31, may be eliminated from the circuit if a power supply of sufficient capacity is attached to terminal 46. Because SCB 24 has an impedance of approximately one ohm, a use involving several devices 1 connected in parallel could easily overload a single power supply. Capacitor 14 is provided to store at device 1 the charge which fires SCB 24.

In the specific embodiment of FIG. 2, capacitor 14 is a 20 uF capacitor having a diameter of approximately 20 mm (0.75 in) and a thickness of approximately 6 mm (0.25 in).

Figure 3:
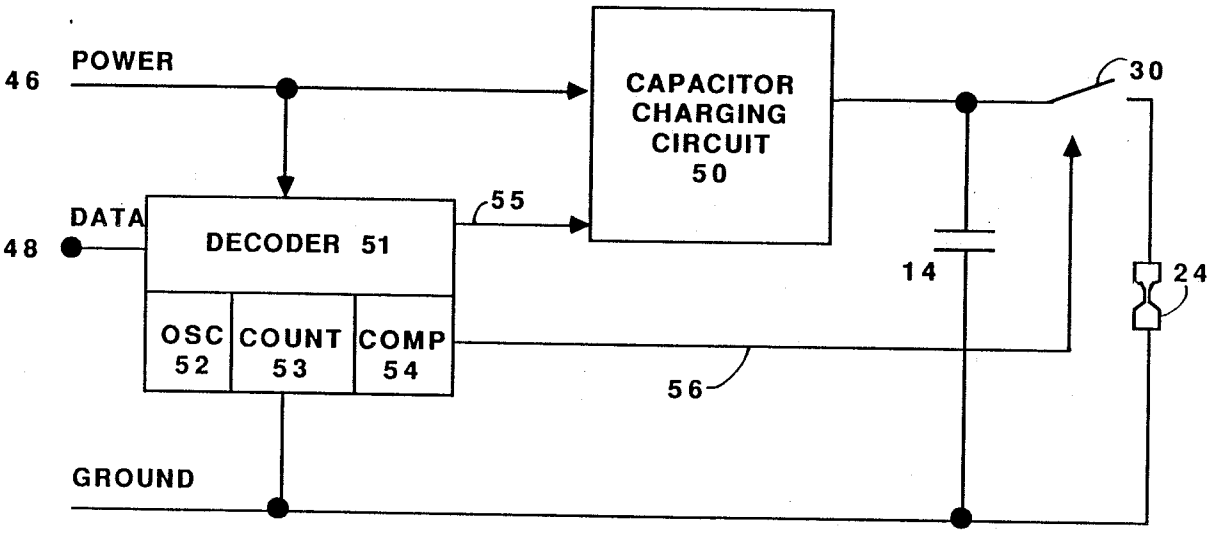
FIG. 3 shows a block circuit diagram in accordance with a second embodiment of the invention.

In many blasting applications, such as building demolition and rock fracturing, it is desirable to set off multiple explosive charges in a predetermined timed sequence. FIG. 3 shows an alternative embodiment of circuit 20 wherein the firing switch 30 is controlled by an output based on a predetermined delay after receipt of the fire signal.

In this embodiment, switch 31 and filter 29 of FIG. 2 are represented by capacitor charging circuit 50. Filter 34, voltage regulator 32 and decoder 38 of FIG. 2 are represented by decoder 51, which decoder energizes charging circuit 50 over line 55 when a first signal is decoded. Upon receipt of the second coded signal, which signal would close switch 30 of FIG. 2, decoder 51 causes counter 53 to count the output of oscillator 52. When a predetermined count representative of a predetermined delay is reached, comparator 54 transmits a signal over line 56 to close switch 30, thereby discharging capacitor 14 through SCB 24.

With suitable logic well known to those of ordinary skill in the art, the circuit of FIG. 3 could also be used to provide for field adjustment of the delay. For example, an input could be provided over line 48 in the field to program comparator 54 to the desired value for triggering switch 30 in response to the total registered on counter 53.

Figure 4B:
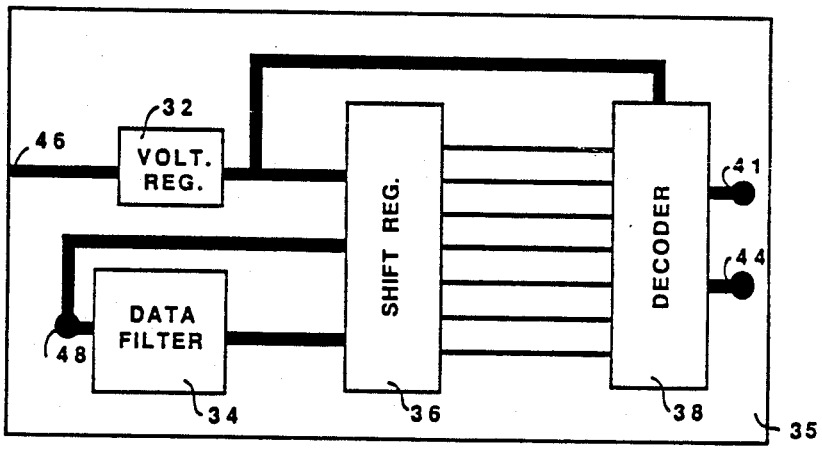

A particular advantage of this invention is the simplicity of its construction. As shown in FIGS. 4A and 5, SCB 24, switches 30 and 31, and filters 23 and 29 may be grown directly on a semiconductor substrate or die 20, permitting the circuit to be made inexpensively and with very small size. The remaining circuitry of FIG. 2, as shown in FIG. 4B, may very inexpensively be placed either on either the same or another substrate. For the first time, this invention provides a low energy igniter that may be fired at a very precise moment in time using computer control.

Additional objects, advantages, and novel features of the invention will become apparent to those skilled in the art upon examination of the following description or may be learned by practice of the invention. The objects and advantages of the invention may be realized and attained by means of the instrumentalities and combinations particularly pointed out in the appended claims.

The particular sizes and equipment discussed above are cited merely to illustrate a particular embodiment of this invention. It is contemplated that the use of the invention may involve components having different sizes and shapes as long as the principle, placing the SCB and triggering switch on the same substrate, is followed. It is intended that the scope of the invention be defined by the claims appended hereto.

We claim:

1. A smart explosive igniter comprising:

a non electrically conducting substrate;

a semiconductor bridge (SCB) mounted on said substrate, said SCB having two electrical terminals;

a semiconductor switch mounted on said substrate adjacent said semiconductor bridge igniter, said switch having an input terminal, an output terminal, and a trigger terminal, said input terminal being electrically connected to said output terminal upon the application of a trigger signal to said trigger terminal;

output means for electrically connecting said output terminal to one of said SCB terminals;

connecting means for electrically connecting a SCB firing voltage between said switch input terminal and the other of said SCB terminals; and trigger means for electrically connecting a trigger voltage between said switch trigger terminal and the other of said SCB terminals.

2. The smart explosive igniter of claim 1 wherein said trigger means further comprises logic means for providing said trigger voltage upon receipt of a preselected coded trigger voltage.

3. The smart explosive igniter of claim 2 wherein said logic means comprises:

shift register means for converting a serial pulse train into a plurality of energized parallel outputs; and network means connected to each of said outputs for providing said trigger voltage only when a preselected pattern of shift register outputs are energized.

4. The smart explosive igniter of claim 3 wherein said logic means is mounted on said substrate.

5. The smart explosive igniter of claim 3 wherein said trigger means further comprises electronic time delay means for providing said trigger signal a predetermined time after receipt of said trigger voltage.

6. The smart explosive igniter of claim 5 wherein said time delay means comprises:

oscillator means energized by said trigger voltage for generating a string of pulses;

counter means for counting said pulses from said oscillator means; and comparison means for providing said trigger signal when the count in said counter means equals a predetermined value in said comparison means.

7. The smart explosive igniter of claim 1 further comprising:

cylindrical housing means having an output end for operational engagement with an explosive and an opposed input end, said substrate being mounted with said housing with said SCB facing said output end; and SCB igniting means for detonating said explosive, said igniting means being ignited by said SCB.

8. The smart explosive igniter of claim 7 further comprising:

a firing capacitor connected between said switch input terminal and said other SCB terminal, said capacitor being mounted between said housing input end and said substrate;

said trigger voltage and said firing voltage being connected to said igniter through said input end.

* * * * *